US008877700B2

(12) United States Patent
Kawasaki

(10) Patent No.: US 8,877,700 B2
(45) Date of Patent: Nov. 4, 2014

(54) AQUEOUS CLEANING AGENT COMPRISING AN ALKANOLAMINE SALT OF AT LEAST ONE CARBOXYLIC ACID

(75) Inventor: Hiroshi Kawasaki, Ichihara (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 0 days.

(21) Appl. No.: 13/822,931

(22) PCT Filed: Aug. 25, 2011

(86) PCT No.: PCT/JP2011/069220

§ 371 (c)(1),
(2), (4) Date: Mar. 13, 2013

(87) PCT Pub. No.: WO2012/035951

PCT Pub. Date: Mar. 22, 2012

(65) Prior Publication Data

US 2013/0196889 A1 Aug. 1, 2013

(30) Foreign Application Priority Data

Sep. 14, 2010 (JP) ..... 2010-205596

(51) Int. Cl.

| | |
|---|---|
| ***C11D 3/37*** | (2006.01) |
| ***C23G 1/06*** | (2006.01) |
| ***C23F 11/12*** | (2006.01) |
| ***C23F 11/14*** | (2006.01) |
| ***C11D 15/04*** | (2006.01) |
| ***C11D 7/26*** | (2006.01) |
| ***C23F 11/10*** | (2006.01) |
| ***C11D 9/00*** | (2006.01) |
| ***C11D 3/00*** | (2006.01) |

(52) U.S. Cl.

CPC ..... *C23G 1/06* (2013.01); *C23F 11/124* (2013.01); *C23F 11/143* (2013.01); *C11D 15/04* (2013.01); *C11D 7/265* (2013.01); *C23F 11/10* (2013.01); *C11D 9/005* (2013.01); *C11D 3/0073* (2013.01); *C11D 9/007* (2013.01)

USPC ..... 510/245; 510/185; 510/254; 510/318; 510/398; 510/434; 510/475; 510/477

(58) Field of Classification Search

USPC ..... 510/185, 245, 254, 318, 398, 434, 475, 510/477

See application file for complete search history.

(56) References Cited

U.S. PATENT DOCUMENTS

| | | | | |
|---|---|---|---|---|
| 5,049,544 | A * | 9/1991 | Koshino et al. | 512/22 |
| 6,673,754 | B1 | 1/2004 | Nabeshima et al. | |
| 8,329,632 | B2 * | 12/2012 | Mikkelsen et al. | 510/321 |
| 2004/0014624 | A1 * | 1/2004 | Bolkan et al. | 510/296 |
| 2007/0096054 | A1 * | 5/2007 | Egawa et al. | 252/73 |
| 2007/0157846 | A1 * | 7/2007 | Sonogi et al. | 106/14.05 |
| 2008/0280806 | A1 * | 11/2008 | Bartelme et al. | 510/446 |
| 2010/0059703 | A1 * | 3/2010 | Yang et al. | 252/76 |

FOREIGN PATENT DOCUMENTS

| | | |
|---|---|---|
| CN | 1405287 | 3/2003 |
| CN | 1743441 | 3/2006 |
| CN | 101611126 A | 12/2009 |
| JP | H06-306662 | 11/1994 |
| JP | 2000 248387 | 9/2000 |
| JP | 2000 336391 | 12/2000 |
| JP | 2003 82380 | 3/2003 |
| JP | 2004 43794 | 2/2004 |
| JP | 2007-016167 | 1/2007 |
| JP | 2007 177166 | 7/2007 |
| JP | 2007 204647 | 8/2007 |
| JP | 05-232381 | 6/2008 |
| JP | 2009-013189 | 1/2009 |
| JP | 2010 77342 | 4/2010 |
| WO | WO 2010/067636 | 6/2010 |

OTHER PUBLICATIONS

International Search Report Issued Nov. 15, 2011 in PCT/JP11/69220 Filed Aug. 25, 2011.

Office Action in corresponding Chinese application No. 201180044063.1, dated Jul. 18, 2014. (w/English translation).

Notice of Reasons for Rejections in corresponding Japanese application No. JP2010-205596, dated Sep. 2, 2014. (w/English translation).

* cited by examiner

*Primary Examiner* — Charles Boyer

(74) *Attorney, Agent, or Firm* — Oblon, Spivak, McClelland, Maier, Neustadt, L.L.P.

(57) ABSTRACT

An aqueous detergent according to the invention contains substantially no polyalkylene glycol, but contains a salt of at least one of the following carboxylic acids A, B and C: A: an aliphatic monobasic carboxylic acid having a total carbon number of 9 or 10 and including a branched alkyl group; B: sebacic acid; and C: an aromatic monobasic carboxylic acid having a total carbon number of 11 to 13.

10 Claims, No Drawings

AQUEOUS CLEANING AGENT COMPRISING AN ALKANOLAMINE SALT OF AT LEAST ONE CARBOXYLIC ACID

CROSS REFERENCE TO RELATED APPLICATIONS

This application is a National Stage of PCT/JP2011/069220 filed on Aug. 25, 2011. This application is based upon and claims the benefit of priority to Japanese Application No. 2010-205596 filed on Sep. 14, 2010.

TECHNICAL FIELD

The present invention relates to an aqueous detergent used for washing machine components and the like.

BACKGROUND ART

Metalworking fluid used in metalworking and subsequent washing is generally categorized into oil-type fluid and water-type fluid, the latter of which is more frequently used because such water-type fluid is excellent in cooling capabilities and infiltration capabilities and free from a risk of causing a fire. In general, stock solution of water-type cutting oil, grinding oil and washing oil is diluted with water to a ratio from 1:1 to 1:200 in use.

When emulsion-type aqueous machining oil is used in the manufacturing process of the automobiles or machine components, cut powders and surface stickiness remain after being dried without applying any treatment. Thus, no-rinse washing is often applied in the subsequent processes using solution-type aqueous detergent (aqueous detergent). The rinsing is omitted in order to reduce waste fluid disposal amount.

For instance, in order to degrease metal, ceramics and the like, an aqueous detergent containing a polyalkylene glycol and non-ionic surface-active agent has been proposed (see Patent Literature 1).

CITATION LIST

Patent Literature

Patent Literature 1: JP-A-2000-336391

SUMMARY OF THE INVENTION

Problems to be Solved by the Invention

The above-described solution-type aqueous detergent (aqueous detergent) is usually practically satisfactory in terms of detergency performance in the sense of removing residual aqueous machining oil from an object to be washed. Instead, rust resistance and hard-water stability at a lower concentration (secondary characteristics common to the aqueous machining oil) tend to be emphasized. Especially, when soap scum (scum) due to hard components (e.g. Ca and Mg) in the diluted water is deposited on the surface of the object to be washed, water is adsorbed the soap scum to result in generation of rust and the like. However, the aqueous detergent disclosed in the above Patent Literature 1 does not necessarily satisfy both of rust resistance and hard-water stability.

Thus, an object of the invention is to provide an aqueous detergent satisfying both of rust resistance and hard-water stability.

Means for Solving the Problems

In order to solve the above problem(s), the present invention provides the following detergent:

(1) An aqueous detergent that comprises substantially no polyalkylene glycol and contains a salt of at least one of the following carboxylic acids A, B and C.

A: an aliphatic monobasic carboxylic acid having a total carbon number of 9 or 10 and including a branched alkyl group.

B: sebacic acid.

C: an aromatic monobasic carboxylic acid having a total carbon number of 11 to 13.

(2) The aqueous detergent according to the above aspect of the invention, in which the salt of the carboxylic acid is at least one of an amine salt and alkali metal salt.

(3) The aqueous detergent according to the above aspect of the invention, in which the aqueous detergent is used for rust prevention.

(4) The aqueous detergent according to the above aspect of the invention, in which a concentration of the salt of the carboxylic acid is in a range from 0.5 g/dL to 30 g/dL based on a total amount of the aqueous detergent.

According to the above aspect of the invention, since substantially no polyalkylene glycol is contained but the specific carboxylate is contained, an aqueous detergent that is excellent in both rust resistance and hard-water stability can be provided. Thus, the invention is suitable for no-rinse washing of machine components and the like.

EXEMPLARY EMBODIMENT

An aqueous detergent according to the invention contains substantially no polyalkylene glycol, but contains at least one of salts of carboxylic acids A, B and C below.

A: an aliphatic monobasic carboxylic acid having a total carbon number of 9 or 10 and including a branched alkyl group B: sebacic acid C: an aromatic monobasic carboxylic acid having a total carbon number of 11 to 13.

The invention will be described below in detail.

The aqueous detergent of the invention contains substantially no polyalkylene glycol.

There are a variety of polyalkylene glycols, which are basically produced by addition polymerization of alkylene oxide (ethylene oxide, propylene oxide, butylene oxide and the like) to a starting material of alcohol, carboxylic acid and the like. Though polyalkylene glycol provides some washing effect to grease stains, polyalkylene glycol is not preferable because bubbling of washing oil is worsened.

The aqueous detergent of the invention contains the salt of the above-mentioned specific carboxylic acid. A description about the above-mentioned carboxylic acids will be given below.

Carboxylic Acid A

The carboxylic acid A in the invention is an aliphatic monobasic carboxylic acid having a total carbon number of 9 or 10 and including a branched alkyl group.

Examples of the aliphatic monobasic carboxylic acid include 3,5,5-trimethylhexanoic acid, cyclohexyl-propionic acid, neodecanoic acid, 2-ethyl-2,3,3-trimethylbutanoic acid, 2-isopropyl-2,3-dimethylbutanoic acid, 2,2,3,3-tetramethylpentanoic acid, 2,2,3,4-tetramethylpentanoic acid, and 2,2,4,4-tetramethylpentanoic acid.

An aliphatic monobasic carboxylic acid of which total carbon number falls outside the above range or an aliphatic monobasic carboxylic acid having a linear alkyl group does not effectively exhibit an advantage of the invention. Especially, when the total carbon number is 8 or less, the aliphatic monobasic carboxylic acid is not preferable in terms of rust resistance and smell. On the other hand, an aliphatic monobasic carboxylic acid having a total carbon number of 11 or more is also not preferable in terms of inferior hard-water stability. Further, a carboxylic acid having a linear alkyl group is not preferable also in terms of inferior hard-water stability.

Carboxylic Acid B

The carboxylic acid B in the invention is sebacic acid (n-decanedioic acid). Sebacic acid is the most preferable in aliphatic dibasic acid in terms of satisfying both of rust resistance and hard-water stability. A polybasic acid (tri(or more) basic acid) is not preferable in terms of satisfying both rust resistance and hard-water stability. The same applied to the below-described carboxylic acid C.

Carboxylic Acid C

The carboxylic acid C in the invention is an aromatic monobasic carboxylic acid having a total carbon number of 11 to 13. The carboxylic acid C does not only exhibit the above advantages of the invention but also is excellent in rot resistance.

An aromatic monobasic carboxylic acid of which total carbon number falls outside the above range does not effectively exhibit advantages of the invention.

Examples of the aromatic monobasic carboxylic acid include p-t-butyl benzoic acid, 1-naphthoic acid, and 4-methyl-1-naphthoic acid.

The aqueous detergent of the invention contains the salt of at least one of the above-described carboxylic acids A to C.

The salt of the carboxylic acid may be an alkali metal salt or an amine salt. Amine salt is preferable considering the deposition of solid contents when being dried.

Examples of the alkali metal salt of the carboxylic acid include sodium salt and potassium salt. In order to prepare such an alkali metal salt, for instance, the carboxylic acid and an alkali compound such as sodium hydroxide, potassium hydroxide, sodium carbonate, sodium silicate, sodium borate and sodium phosphate are reacted.

Though the amine salt of the carboxylic acid may be a salt of aliphatic amine or a salt of an aromatic amine, a salt of alkanolamine represented by the following formula (1) or (2) is favorable in terms of rust resistance.

Formula 1

(1)

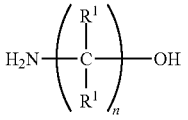

Formula 2

(2)

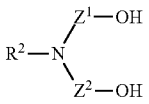

In the above formula (1), each of $R^1$ represents hydrogen or an alkyl group having 1 to 3 carbon atoms. n represents 2 or 3. Each of the plural $R^1$ may be mutually the same or different on condition that not all $R^1$ represent hydrogen. In other words, the alkanolamine is not monoethanolamine. When n is 4 or more, solubility of the carboxylate provided by the alkanolamine is unfavorably reduced. n is the most preferably 2. When n is 1, formaldehyde may be unfavorably easily discharged due to degradation. In addition, when any one of $R^1$ has 4 or more carbon atoms, the solubility thereof and rust resistance for iron are unfavorably deteriorated.

Examples of the alkanolamine represented by the formula (1) are 1-amino-2-propanol, 2-amino-2-methyl-1-propanol, 1-amino-2-butanol, 2-amino-1-propanol, 3-amino-2-butanol and the like. Among the above, in view of the rust resistance for iron, 1-amino-2-propanol and 2-amino-2-methyl-1-propanol are particularly preferable. In the invention, the components may contain single one of the above substances or plural ones of the above substances.

Next, alkanolamine represented by the formula (2) will be described. In the formula, $R^2$ represents an alkyl group having 1 to 10 carbon atoms. When $R^2$ represents hydrogen, rot resistance is unfavorably deteriorated. When $R^2$ has a non-cyclic structure, the alkyl group represented by $R^2$ preferably has 1 to 4 carbon atoms, more preferably 1 carbon atom. When $R^2$ contains 11 or more carbon atoms, solubility and rust resistance of the carboxylate provided by the alkanolamine are unfavorably deteriorated. $Z^1$ and $Z^2$ each independently represent an alkylene group having 2 to 8 carbon atoms. When the number of the carbon atoms contained in at least either one of $Z^1$ and $Z^2$ is 1, the alkanolamine salt is degraded to generate formaldehyde, which is environmentally unfavorable. When the number of the carbon atoms contained in at least either one of $Z^1$ and $Z^2$ is 9 or more, solubility of the carboxylate provided by the alkanolamine are unfavorably deteriorated.

Examples of the alkanolamine represented by the formula (2) include N-methyldiethanolamine, N-ethyl diethanolamine, cyclohexyl diethanolamine, N-n-propyl diethanolamine, N-i-propyl diethanolamine, N-n-butyl diethanolamine, N-i-butyl diethanolamine, and N-t-butyl diethanolamine. $R^2$ preferably includes a branched alkyl structure or a cycloalkyl structure because rot resistance can be enhanced. $R^2$ is particularly preferably cyclohexyl diethanolamine. In the invention, the components may contain single one of the above substances or plural ones of the above substances. It should be understood that both of the alkanolamine represented by the formula (1) and the alkanolamine represented by the formula (2) may be simultaneously used.

The aqueous detergent of the invention is prepared by dissolving (dispersing) the above carboxylate into water. In view of handling ability, it is preferable that a high-concentration stock solution is initially prepared. In such a case, a user by himself/herself dilutes the stock solution with water before using as the aqueous detergent. The water to be used may be either hard water or soft water. Thus, the water used may be tap water, industrial water, ion-exchange water, distilled water and the like as desired.

When the stock solution is initially prepared, the concentration of the above-described carboxylate is preferably 70 g/dL or less, more preferably 50 g/dL or less. When the concentration exceeds 70 g/dL, the detergent components may not be easily dissolved in water when preparing the stock solution.

The desirable concentration of the aqueous detergent (diluting fluid) is 0.5 g/dL or more and 30 g/dL or less in terms of carboxylate based on the total amount of the aqueous detergent, and more preferably 1 g/dL or more and 10 g/dL or less. The concentration of the carboxylate in the above range provides a detergent excellent both in rust resistance and hard-water stability.

The aqueous detergent may be blended as necessary with publicly-known various kinds of additives as long as an object of the present invention is not hampered. Examples of the additives include aqueous anticorrosive agent, antifoaming agent, bactericide and antioxidant.

Examples of aqueous anticorrosive agent include: triazoles such as benzotriazole, methyl benzotriazole, tolyltriazole and hydrocarbyl triazole, and salt thereof; sodium salt or potassium salt of an inorganic acid such as boric acid, tungsten acid, molybdenum acid, phosphoric acid, sulfuric acid, silicic acid, nitric acid and nitrous acid; thiazoles such as mercaptobenzothiazole, and salt thereof; aliphatic alkanolamides; imidazolines; and oxazolines.

Examples of the antifoaming agent are methyl silicone oil, fluorosilicone oil, polyacrylate and the like.

Preferable examples of bactericide include salicylanilide compound and 2-pyridylthio-1-oxide salt. Examples of 2-pyridylthio-1-oxide salt are 2-pyridylthio-1-oxide sodium, zinc bis(2-pyridylthio-1-oxide), bis(2-sulfidepyridine-1-olato) copper and the like. Among the above, 2-pyridylthio-1-oxide sodium is particularly preferable because the substance is effective on general bacteria and molds in a wide range even when contained therein with a low concentration.

Examples of usable antioxidant include various antioxidants such as phenolic antioxidants, amine antioxidants, sulfuric antioxidants and phosphoric antioxidants.

A total mixing content of the above various additives is preferably 3 mass% or less of the total amount of the composition.

EXAMPLES

Next, the invention will be described in detail with reference to Examples. However, the present invention is not limited at all by the Examples.

Examples 1 to 7 and Comparatives 1 to 36

The various carboxylic acids shown in Table 1 were mixed with N-methyldiethanolamine, which was diluted with water to prepare amine salt solution of each of the carboxylic acids. The amine salt solution (sample) was evaluated in terms of rust resistance and hard-water stability. Results are shown in Table 1. Details of the evaluation methods are as follows.

Evaluation Method of Rust Resistance 1) 2.00 gram mixture of N-methyldiethanolamine and each of the carboxylic acids was scaled and put in a 100 ml beaker so that amine/acid equivalent ratio became 3.

2) After being added with approximately 20 ml of ion-exchange water, the mixture was agitated while heating so that the substances were uniformly dissolved.

3) The amine salt solution after the substances were dissolved was quantitatively transferred to a 100 ml-stoppered measuring cylinder and, subsequently, the amine salt solution was diluted with ion-exchange water to provide 100 ml constant volume of aqueous solution with a concentration of 2.0 g/dL.

4) Ion-exchange water and the above aqueous solution were mixed at ratios of 30:10, 20:20 and 10:30 to prepare amine salt solutions of concentrations of 0.5 g/dL, 1.0 g/dL and 1.5 g/dL. Subsequently, the 0.5 g/dL, 1.0 g/dL and 1.5 g/dL-concentration solutions as well as the aqueous solution of 2.0 g/dL concentration were subjected to a cut-powder test (DIN51360-02A).

5) An aqueous solution that caused rust and an aqueous solution that caused no rust in the above 4) were selected and the selected aqueous solutions were mixed at ratios of 8:2, 6:4, 4:6 and 2:8 (with this process, aqueous solutions with intermediate concentration (i.e. in increments of 0.1 g/dL) could be prepared), which were similarly subjected to the cut-powder test (DIN51360-02A).

6) The minimum concentration caused no rust was defined as a rust-prevention limit concentration (g/dL).

Evaluation Method of Hard-Water Stability 1) 1.00 gram mixture of N-methyldiethanolamine and carboxylic acid was scaled and put in a 100 ml beaker so that amine/acid equivalent ratio became 3.

2) After being added with approximately 20 ml of ion-exchange water, the mixture was agitated while heating so that the substances were uniformly dissolved.

3) The dissolved solution was quantitatively transferred to a 100 ml-stoppered measuring cylinder, was added with 20 mL of Ca hard water (hardness 5000, $CaCl_2$ 5.54 g/L) and was further added with ion-exchange water to provide 100 ml constant volume of 1.0 g/dL-concentration aqueous solution with a hardness of 1000. Incidentally, in the later-described Examples 8, 9 and 10, a predetermined stock solution was initially prepared and was diluted with water twentyfold before evaluation.

4) After leaving still for 24 hours at a room temperature, the formation of scum was inspected according to the following standards.

S: transparent, A: slightly misted, B: substance deposited

Practically, it is preferable that the sample is evaluated as S or A.

TABLE 1

| | Carboxylic Acid | Total Carbon Number | Rust-Prevention Limit (g/dL) | Hard-Water Stability |
|---|---|---|---|---|
| Example 1 | 3,5,5-trimethylhexanoic acid | 9 | 0.5 | S |
| Example 2 | cyclohexyl-propionic acid | 9 | 0.5 | S |
| Example 3 | neodecanoic acid | 10 | 0.5 | A |
| Example 4 | n-decanedioic acid (sebacic acid) | 10 | 0.8 | S |
| Example 5 | p-t-butyl benzoic acid | 11 | 0.5 | S |
| Example 6 | 1-naphthoic acid | 11 | 1.1 | S |
| Example 7 | 4-methyl-1-naphthoic acid | 12 | 0.6 | S |
| Comparative 1 | (amine only) | — | 1.5 | S |
| Comparative 2 | glycolic acid | 1 | 2< | S |
| Comparative 3 | n-pentanoic acid | 5 | 2< | S |
| Comparative 4 | n-hexanoic acid | 6 | 1.5 | S |
| Comparative 5 | n-heptanoic acid | 7 | 0.8 | S |
| Comparative 6 | 2-propylpentanoic acid | 8 | 1.3 | S |
| Comparative 7 | n-octanoic acid | 8 | 0.5 | A |
| Comparative 8 | 2-ethylhexanoic acid | 8 | 1.5 | S |
| Comparative 9 | n-nonanoic acid | 9 | 0.5 | B |

TABLE 1-continued

| | Carboxylic Acid | Total Carbon Number | Rust-Prevention Limit (g/dL) | Hard-Water Stability |
|---|---|---|---|---|
| Comparative 10 | n-decanoic acid | 10 | 0.8 | B |
| Comparative 11 | 10-undecenoic acid | 11 | 0.7 | B |
| Comparative 12 | n-dodecanoic acid | 12 | 0.6 | B |
| Comparative 13 | myristic acid | 14 | 0.7 | B |
| Comparative 14 | palmitinic acid | 16 | 0.8 | B |
| Comparative 15 | isostearic acid | 18 | 0.7 | B |
| Comparative 16 | oleic acid | 18 | 0.8 | B |
| Comparative 17 | n-pentanedioic acid (glutaric acid) | 5 | 2< | S |
| Comparative 18 | n-hexanedioic acid (adipic acid) | 6 | 2< | S |
| Comparative 19 | n-heptanedioic acid (pimelic acid) | 7 | 2< | S |
| Comparative 20 | n-octanedioic acid (suberic acid) | 8 | 2< | S |
| Comparative 21 | 1,4-cyclohexanedicarboxylic acid | 8 | 2< | S |
| Comparative 22 | n-nonanedioic acid | 9 | 1.7 | S |
| Comparative 23 | undecanedioic acid | 11 | 0.4 | B |
| Comparative 24 | dodecanedioic acid | 12 | 0.4 | B |
| Comparative 25 | pendadecanedioic acid | 15 | 0.5 | B |
| Comparative 26 | 7-ethyloctadecanedioic acid | 20 | 0.6 | B |
| Comparative 27 | benzoic acid | 7 | 2< | S |
| Comparative 28 | p-toluylic acid | 8 | 1.3 | S |
| Comparative 29 | 2,4,6-trimethylbenzoic acid | 10 | 2< | S |
| Comparative 30 | p-n-butylbenzoic acid | 11 | 0.5 | B |
| Comparative 31 | 2-naphthoic acid | 11 | 0.7 | B |
| Comparative 32 | 2-phenylbenzoic acid | 13 | 2< | S |
| Comparative 33 | 4-phenylbenzoic acid | 13 | 0.5 | B |
| Comparative 34 | phthalic acid | 8 | 2< | S |
| Comparative 35 | 1,4-naphthalenedicarboxylic acid | 12 | 2< | S |
| Comparative 36 | 2,6-naphthalenedicarboxylic acid | 12 | 0.9 | B |

Evaluation Result

The carboxylic acids used in Examples 1 to 7 fall under the definition of the invention. Accordingly, the amine salts provided by the carboxylic acids exhibited excellently balanced rust resistance and hard-water stability. In contrast, the carboxylic acids used in Comparatives 1 to 36 do not fall under the definition of the invention. Accordingly, even when used in the form of the amine salts, at least one of rust resistance and hard-water stability was inferior. Incidentally, though Comparative 1 in which amine was solely used exhibited favorable hard-water stability, Comparative 1 exhibited poor rust resistance.

Examples 8, 9 and 10

Examples 8 and 9 in Table 2 show a composition (stock solution) to be used as an iron-and-aluminum detergent. Example 10 in Table 2 shows a composition (stock solution) to be used as a detergent dedicated for aluminum. These stock solutions were diluted with water for evaluation. Specifically, in addition to the above-described rust resistance and hard-water stability, defoaming properties and discoloration of an aluminum piece were evaluated according to the following processes.

Defoaming Properties

The defoaming properties were evaluated according to a cylinder method. Specifically, 98 mL of tap water was put into a 100 ml-stoppered measuring cylinder and was added with 2 mL of the stock solution, which was then lightly shook to prepare a 2 volume % of diluted solution. The cylinder was vigorously shook up and down for five seconds and was subsequently left still. The time required before a half of a liquid interface could be seen was recorded as a defoaming time (second(s)).

Recording Method

When the foams were disappeared within thirty seconds, the time (second(s)) at which the foams were disappeared was recorded.

Examples of Record

When disappeared in twenty seconds . . . 20-0

When disappeared in fifteen seconds . . . 15-0

Aluminum-Dipping Test

The following two test pieces were prepared.

JIS A6061 (aluminum alloy): 25×75×1 mm

JIS ADC12 (aluminum alloy): 19×80×11 mm

Next, the surfaces of each of the metal pieces were uniformly polished with a strip of sandpaper (C320). Subsequently, the above polished metal pieces were entirely immersed in a beaker in which acetone was put and were washed for five minutes with an ultrasonic cleaner.

Further, the above stock solution was put into a 100-mL lidded sample bottle and was diluted twentyfold with ion-exchange water.

The above metal pieces were immediately air-dried after being taken out of acetone and were entirely immersed in the diluted solution. Then, after the lid of the sample bottle was closed, the bottle was left still for two hours in a constant temperature bath of 60 degrees C. Then, after the metal pieces were taken out and washed with tap water and moisture was wiped off, the discoloration of the polished part was visually checked according to the following standards.

A: no discoloration, B: less than 50% discolored, C: 50% or more discolored, D: blackened

TABLE 2

| | | Example 8 | Example 9 | Example 10 |
|---|---|---|---|---|
| Composition (g/dL) | isononanoic acid | 6.4 | 7.3 | 5.5 |
| | benzotriazole | 0.5 | 0.5 | 0.5 |
| | N-methyldiethanolamine | 23.5 | 13.9 | — |
| | Triisopropanolamine | — | 7.5 | 23.2 |
| | tap water | 68.8 | 70.0 | 70.0 |
| | isothiazoline bactericide | 0.4 | 0.4 | 0.4 |
| | silicone antifoaming agent | 0.2 | 0.2 | 0.2 |
| | aluminum discoloration- | 0.2 | 0.2 | 0.2 |

TABLE 2-continued

| | | Example 8 | Example 9 | Example 10 |
|---|---|---|---|---|
| | prevention agent | | | |
| | Total | 100.0 | 100.0 | 100.0 |
| Evaluation Results | pH (5% aq) | 9.5 | 8.9 | 8.4 |
| | rust-prevention limit (g/dL) | 2.5 | 3.0 | 4.1 |
| | hard-water stability (5% aq) | S | S | S |
| | antifoaming capabilities | 10-0 | 9-0 | 7-0 |
| | aluminum immersion test (60° C. × 2 h) | | | |
| | A-6061 | A | A | A |
| | ADC12 | A | A | A |

Evaluation Result

As can be understood from the results shown in Table 2, the detergent of the invention are excellent in antifoaming capabilities as well as rust resistance and hard-water stability and, in addition, does not discolor aluminum. Therefore, it can be understood that the detergent according to the invention is excellent in terms of practical utility.

The invention claimed is:

1. An aqueous detergent that comprises substantially no polyalkylene glycol, the aqueous detergent comprising a salt of at least one of carboxylic acids A, B and C below:

A: an aliphatic monobasic carboxylic acid having a total carbon number of 9 or 10 and comprising a branched alkyl group;

B: sebacic acid; and

C: an aromatic monobasic carboxylic acid having a total carbon number of 11 to 13, wherein the salt of the carboxylic acid is a salt of at least one amine selected from the group consisting of an alkanol amine represented by formula (1), an alkanolamine represented by formula (2) and triisopropanolamine:

(1)

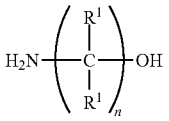

wherein each $R^1$ independently represents hydrogen or an alkyl group having 1 to 3 carbon atoms, where not all of the $R^1$ groups are hydrogen; and n represents 2 or 3, (2)

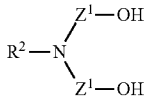

wherein $R^2$ represents an alkyl group having 1 to 10 carbon atoms; and $Z^1$ and $Z^2$ independently represent an alkylene group having 2 to 8 carbon atoms.

2. The aqueous detergent according to claim 1, which is suitable for rust prevention.

3. The aqueous detergent according to claim 1, wherein a concentration of the salt of the carboxylic acid is in a range from 0.5 g/dL to 30 g/dL based on a total amount of the aqueous detergent.

4. The aqueous detergent according to claim 2, wherein a concentration of the salt of the carboxylic acid is in a range from 0.5 g/dL to 30 g/dL based on a total amount of the aqueous detergent.

5. The aqueous detergent according to claim 1, wherein the carboxylic acid is an aliphatic monobasic carboxylic acid having a total carbon number of 9 or 10 and comprising a branched alkyl group.

6. The aqueous detergent according to claim 1, wherein the carboxylic acid is sebacic acid.

7. The aqueous detergent according to claim 1, wherein the carboxylic acid is an aromatic monobasic carboxylic acid having a total carbon number of 11 to 13.

8. The aqueous detergent according to claim 1, wherein the salt of the carboxylic acid is a salt of an alkanol amine represented by the formula (1).

9. The aqueous detergent according to claim 1, wherein the salt of the carboxylic acid is a salt of an alkanolamine represented by the formula (2).

10. The aqueous detergent according to claim 1, wherein the salt of the carboxylic acid is a salt of triisopropanolamine.

* * * * *